US005394587A

United States Patent [19]

Parise

[11] Patent Number: 5,394,587

[45] Date of Patent: Mar. 7, 1995

[54] HOT WATER VACUUM EXTRACTION MACHINE WITH FLOAT SEALED RISER TUBE SHUT-OFF DEVICE

[75] Inventor: Carl Parise, Reno, Nev.

[73] Assignee: Thermax, Inc., Reno, Nev.

[21] Appl. No.: 162,778

[22] Filed: Dec. 8, 1993

[51] Int. Cl.[6] ..... A47L 7/00

[52] U.S. Cl. ..... 15/353; 15/321; 55/216

[58] Field of Search ..... 15/353, 321; 55/216

[56] References Cited

U.S. PATENT DOCUMENTS

| | | | |
|---|---|---|---|
| 2,212,429 | 8/1940 | Yutzler | 55/216 |
| 2,989,769 | 6/1961 | Houser | 15/401 X |
| 3,082,465 | 3/1963 | Wood | 15/353 X |
| 3,180,071 | 4/1965 | Nolte | 15/353 X |
| 3,343,199 | 9/1967 | Nolte | 15/353 X |
| 4,078,908 | 3/1978 | Blackman | 15/353 X |
| 4,142,270 | 3/1979 | Nauta | 15/353 |
| 4,821,367 | 4/1989 | McAllister et al. | 15/353 |

FOREIGN PATENT DOCUMENTS

| | | | |
|---|---|---|---|
| 3511574 | 10/1986 | Germany | 15/353 |

*Primary Examiner*—Christopher K. Moore
*Attorney, Agent, or Firm*—Sughrue, Mion, Zinn, Macpeak & Seas

[57] ABSTRACT

A steam cleaner recovery tank has an inverted cup shape dome sealed thereto. An upright riser tube mounted to the recovery tank bottom wall extends into the dome. A flat horizontal plate intersects the vertical upright riser tube and supports a float ball at a rest position below a riser tube inlet port shielded from a dirt-free return air stream. The float ball rises by contact with liquid accumulating within the recovery tank. The float ball is of a density so as to be rapidly sucked into the inlet port by the dirt-free return air stream. A perforated cup integrally molded to the flat plate supports the float ball in one embodiment and forms a shield. In a second embodiment, a cylindrical wire mesh screen is fixed to the bottom of the flat plate, to the side of the riser tube. The float ball is positioned in the filter screen and the second circular hole constitutes the risers tube inlet port. An air imperforate shrink tube acts as a shield.

15 Claims, 5 Drawing Sheets

HOT WATER VACUUM EXTRACTION MACHINE WITH FLOAT SEALED RISER TUBE SHUT-OFF DEVICE

FIELD OF THE INVENTION

This invention relates to hot water vacuum cleaners in which atomized, detergent-containing hot water may be sprayed on objects to be cleaned such as rugs or other floor surfaces and suction removed, and more particularly to a recovery tank riser tube fixed to the tank bottom, and extending upwardly above the level of the water and open to the interior of the recovery tank for communicating the vacuum pressure of the recovery tank to an extraction machine casing carried vacuum pump, and a float ball capable of closing off the top of the riser tube to prevent water returning with the airstream to the vacuum pump and its drive motor when overfilling the recovery tank with water.

BACKGROUND OF THE INVENTION

Hot water vacuum extraction machines or vacuum cleaners generally incorporate a removable, recovery tank or dump bucket for separating the detergent-containing hot water from the airstream after pickup by a vacuum head at the end of the suction hose remote from the extraction machine. By incorporating a hydro-air filter within the recovery tank or dump bucket, with one end of the hydro-air filter immersed in water within the recovery tank, dirty air under vacuum pressure returning to the recovery tank from vacuum cleaner vacuum head mixes with the water, accumulating within the bucket or provided to the same, to filter out dirt particles. The dirt particles separate from the airstream and are retained by the water. The dirt-free airstream is released to a space defined by the top of the recovery tank and an overlying dome cover, above the level of water within the recovery tank. The dirt free airstream passes downwardly through a riser tube under suction pressure from a vacuum pump coupled to the lower end of the riser tube. The clean air escaping from the recovery tank and after passage through the suction pump is permitted to escape through openings within the hot water vacuum extraction machine casing to which the recovery tank is removably mounted.

Hydro-air filters or aqua filters are found within vacuum extraction machines exemplified by U.S. Pat. No. 4,078,908 issued Mar. 14, 1978 to R. Eugene Blackman and entitled "Dump Bucket for a Wet-Dry Vacuum System Having Improved Liquid Flow Characteristics:"; U.S. Pat. No. 4,083,705 issued Apr. 11, 1978 to Carl Parise et al and entitled "Dump Bucket for a Wet/Dry Vacuum System"; and U.S. Pat. No. 4,145,198 issued Mar. 20, 1979 to Thomas M. Laule and entitled "Hot Water Vacuum Extraction Machine with Submicron Size Particle Filter".

Such hot water vacuum extraction machines, whether used in a dry vacuum cleaner mode or wet vacuum cleaner mode, often include additional filters other than the hydro-air filter for separating the dirt from the wet or dry airstream entering the recovery tank dome to prevent dirt particles and droplets of water from passing to the vacuum pump and/or the electric motor driving the vacuum pump and which can contaminate those parts. Typically, a screen type filter is fixed to the inlet end of the riser tube to permit the return air to pass through the riser tube and out of the bottom of the recovery tank through a riser tube outlet port coupled by an air passage or duct within or beneath the bottom of the machine casing and opening to the suction side of the suction pump.

While the inlet opening to the riser tube is normally at a level well above the level of water within the tank to effect a hydro-air filter action for the return airstream carrying the dirt particles, overfilling of the recovery tank may occur with the water level rising dangerously close to the inlet port of the riser tube. Additionally, the incoming airstream tends to agitate the water accumulating within the bottom of the recovery tank or purposely prefilled therein, for effecting a hydro-air filter action, causing droplets of water to splash upwardly in the vicinity of the riser tube inlet port.

Attempts have been made to install baffles within the recovery tank between the water and the riser tube inlet port to reduce water splash and movement of water particles along the exterior of the user tube towards the riser tank inlet port. While such baffles and the like perform adequately, there is no guarantee that some water will not enter the riser tube and be sucked down into the vacuum pump or reach its electrical drive motor.

It is therefore a primary object of the present invention to provide a hot water vacuum extraction machine employing a hydro-air filter with a float sealed riser tube for automatically sealing off the inlet port to the riser tube as a result of predetermined volume of water accumulating within the recovery tank and to prevent water splashing into the open inlet port of the riser tube upon overfilling of the recovery tank with water.

It is a further object of this invention to provide a float sealed riser tube inlet port shut-off device which employs a float ball of a predetermined density normally maintained by gravity within a cage or cup to the side of the riser tube and below the level of the inlet port, which float ball upwardly by the rising level of water within the recovery tank, and which moves into the airstream entering the inlet port of riser tube where, such airstream causes the float ball to move rapidly into a position sealing off the inlet port to the riser tube well before the water level reaches the riser tube air inlet port, thereby preventing water from entering into the inlet port and reaching the vacuum pump.

It is a further object of the invention to provide a float ball integrated to a screen filter to a side of the riser tube for automatically closing off an air passage connecting the interior of the filter screen and constituting an inlet port of the riser tube and wherein, with the filter screen and its supporting structure acting as a cage for the float ball as well as means for shielding the float ball, in its normal gravity induced rest position at the bottom of the filter screen structure, from the air stream seeking the riser tube inlet port to thereby prevent premature movement of the float ball into a position sealing off that inlet port.

DESCRIPTION OF THE PREFERRED EMBODIMENTS

Figure 1:
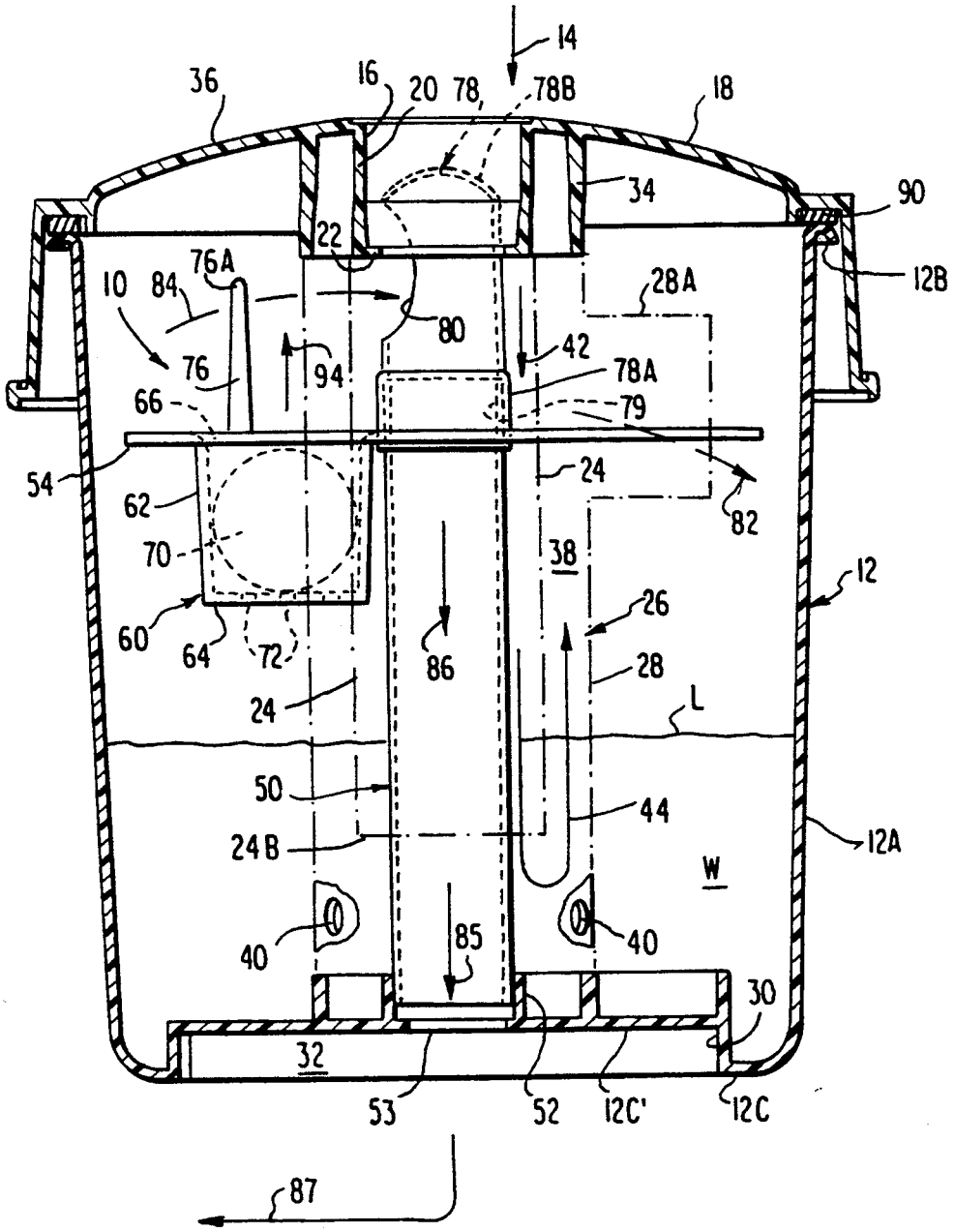
FIG. 1 is a schematic, vertical sectional view of a recovery tank of a hot water vacuum extraction machine with an automatic float ball device shut-off for sealing off the riser tube inlet port, forming a preferred embodiment of the invention.
Figure 2:
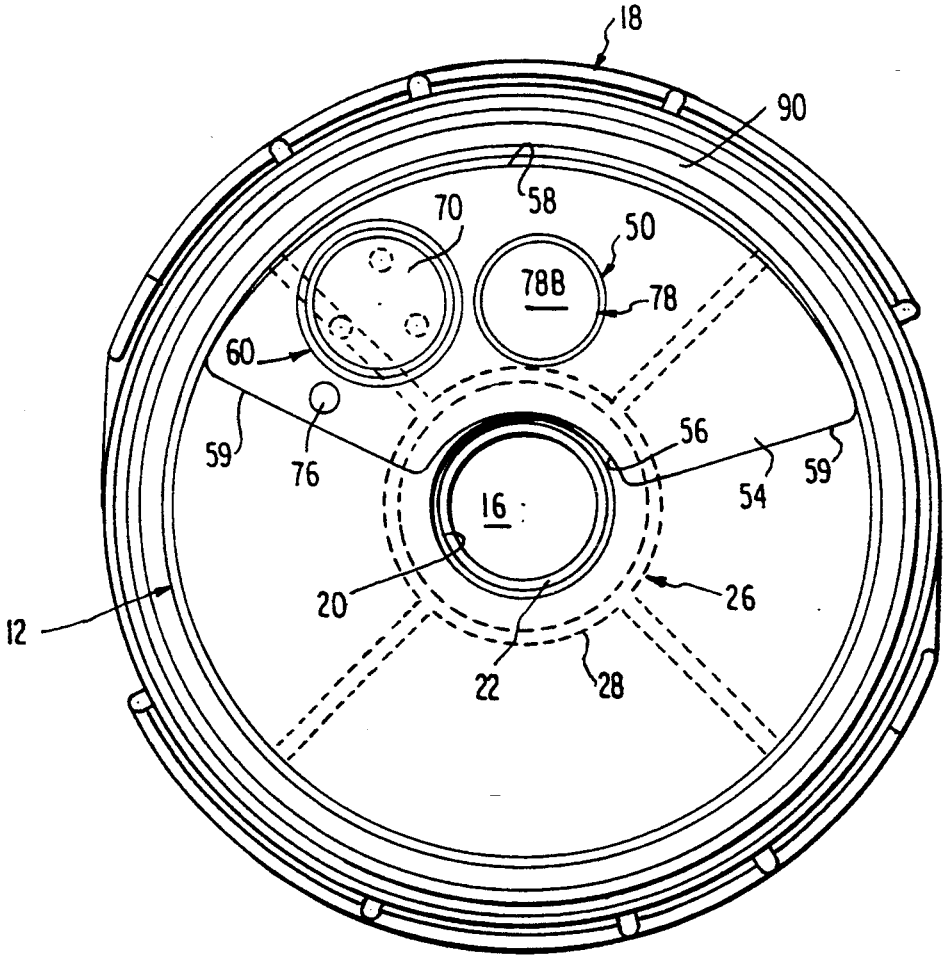
FIG. 2 is a schematic, top plan view of the recovery tank of FIG. 1 and the automatic shut-off device for float ball sealing of the inlet port of the riser tube.
Figure 3:
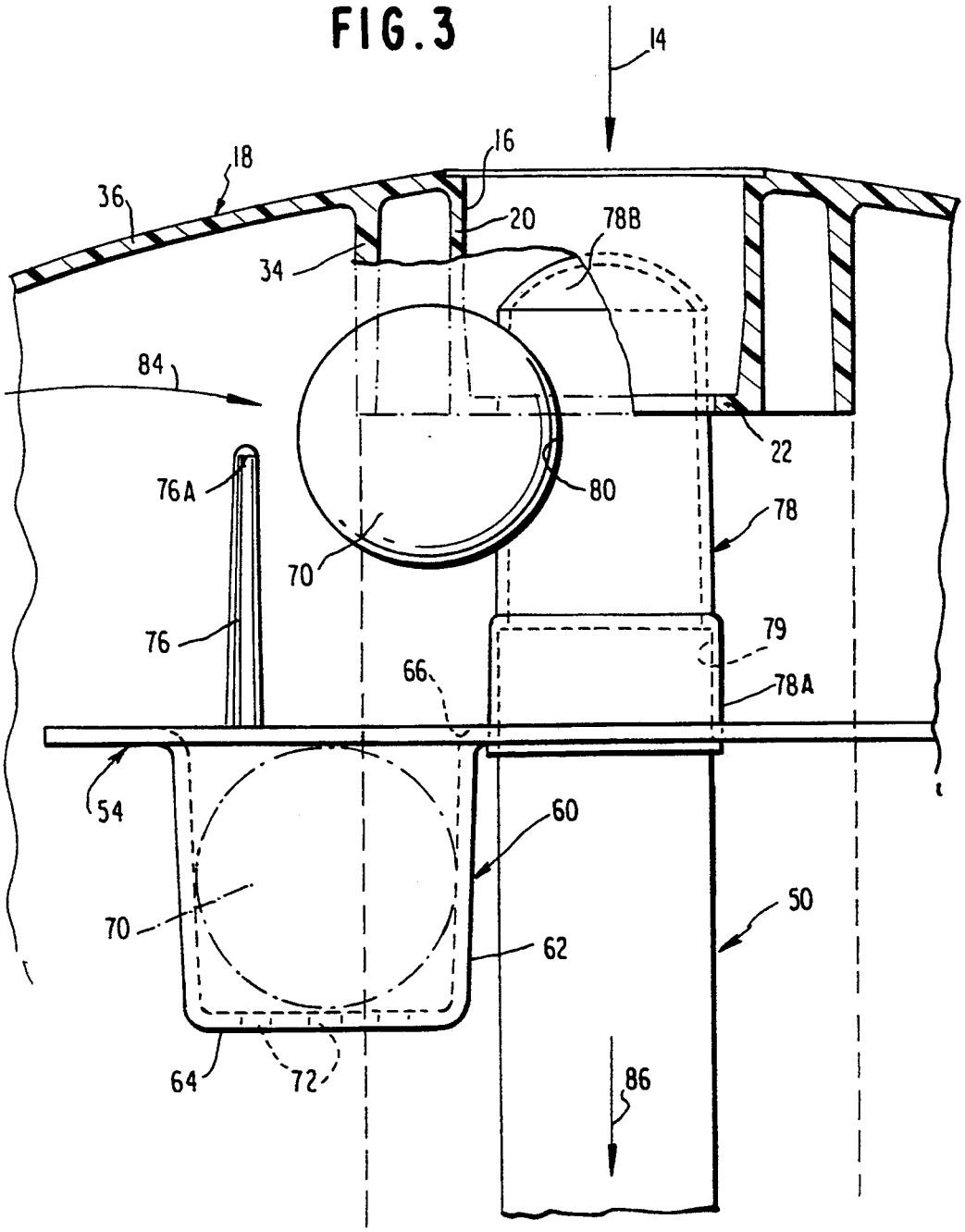
FIG. 3 is an enlarged, schematic, vertical sectional view of the riser tube inlet port sealing mechanism with the float ball sealed against the inlet port of the riser tube by suction.

Referring to drawing FIGS. 1–3 inclusive, the ball float riser tube inlet port shut-off device, indicated generally at 10, and forming a first embodiment of the invention, is incorporated within a recovery tank indicated generally at 12 of a hot water vacuum extraction machine which is the subject of U.S. Pat. No. 5,343,592 issued Sept. 6, 1994, entitled "Hot Water Vacuum Extraction Machine with Submicron Size Particle Filter" assigned to the common assignee. The content of that application is specifically incorporated herein by reference.

FIG. 1 illustrates schematically, the return airstream by arrow 14 which is aligned with the axis of a return fluid inlet port 16 of the dome or cover 18 of the recovery tank 12. The dome or cover 18 is normally transparent or translucent so that the level L of water W accumulating within the bottom of the recovery tank 12, or prefilled therein, may be readily seen, as well as the condition of that water. The return fluid inlet port 16 is defined by a first small diameter annular wall 20 integral with the dome top wall 36, having a generally vertical axis, and terminating in a radially inward directed annular rim 22. Suspended on the rim 22 is a small diameter inner tube 24 of an aqua filter tube assembly indicated generally at 26, further defined by a large diameter water entraining tube 28. The aqua filter tube assembly 26 constitutes a hydro-air filter for filtering out dirt particles of the incoming stream 14 by causing that incoming, return airstream as per arrow 42 within innertube 24 to percolate through a given level L of mass of water W, which may accumulate by gravity within the bottom of the recovery tank 12.

The recovery tank 12 is comprised of an annular outer wall 12A terminating at its top, in a radially outwardly directed lip 12B, and is closed off by an integral bottom wall 12C. A circular recess 30 is provided within the bottom wall 12C, defined by a raised bottom wall portion 12C'. The recess 30 partially form a filter assembly chamber 32 which receives a micron size particle filter assembly (not shown), which is the subject matter of U.S. Pat. No. 5,343,592. The recess 30 and filter assembly chamber 32 do not form aspects of the present invention.

For purposes of understanding the makeup and operation of the ball float riser tube inlet port sealing mechanism 10, it should be appreciated that the water entraining tube 28 of the aqua filter tube assembly 26 extends downwardly from a larger diameter annular wall 34 integral with the spherical top wall 36 of the dome or cover 18 to the recovery tank bottom wall 12C and concentrically surrounds and is spaced from the smaller diameter, inner tube 24. The water entraining tube 28 extends in sealed fashion from annular wall 34 to the recessed bottom wall portion 12C' of the recovery tank 12. To the contrary, the smaller diameter inner tube 24 terminates some distance above the recessed, central bottom wall portion 12C' of the recovery tank, in a lower edge 24B which permits the return flowstream 14 to reverse its direction of movement and enter into an annular space 38 between the inner tube 24 and the water entraining tube 28 of the aqua filter tube assembly 26. There exists one or more small diameter holes or openings 40 within the side of the water entraining tube 28 at its lower end, near the bottom of the recovery tank 12. This permits the water W, accumulating within the recovery tank or purposely placed therein, to pass into the annular space 38 as well as to enter the bottom of the small diameter inner tube 24. The incoming airstream as illustrated by arrow 42, in passing downwardly within the interior of the small diameter inner tube 24 reaches the level L' of the water W and percolates through that water by passing underneath the lower edge 24B of the inner tube 24. The dirt 2 held length water W and dirt-free air as indicated by arrow 44 passes upwardly within the annular space 38. Reference to U.S. Pat. No. 5,343,592 may be had for a better understanding of the nature in which that dirt free air is discharged radially from a projection 28A of the water entraining tube 28 into the interior of the recovery tank 12 as per arrow 82 of the water entraining tube 28. Such dirt free air then seeks to escape the interior of the recovery tank 12.

Escape of dirt free air is accomplished by use of an upright riser tube indicated generally at 50 whose lower end is sealably fixed within a vertically upright, circular wall 52 molded integrally with the recessed portion 12C' of the recovery tank bottom wall 12C. A riser tube air outlet port or opening 53 is formed within the recovery tank recessed bottom wall portion 12C' and is open to suction pressure from a suction pump or source indicated by arrow 87, FIG. 1 within the hot water vacuum extraction machine remote from the recovery tank 12. The riser tube 50 extends vertically upward to and terminates just short of the dome or cover 18. In similar fashion to the hot water vacuum extraction machine of U.S. Pat. No. 5,343,592, there is provided a water baffle plate of arcuate sector form, indicated generally at 54, FIG. 2, having a radially inner, arcuate wall 56 and a radially outer, arcuate wall 58. Plate 54 extends circumferentially about 120° and terminates at opposite ends in radial sidewalls 59. The water baffle plate 54 includes a circular opening 63 through which projects the riser tube 50, sized thereto. Any splashing of the water W accumulating within the recovery tank 12 and tending to aspirate into inlet port at the top of the riser tube 50, by suction pressure is thereby normally prevented by the presence of the baffle plate 54. Such structural content is fully shown in U.S. Pat. No. 5,343,592.

In the illustrated embodiment of FIGS. 1 and 3, the baffle plate 54, which is molded preferably of an ABS plastic, includes an integral float ball cup, indicated generally at 60, including an upwardly and outwardly tapered conical sidewall 62, and a flat, horizontal bottom wall 64. The cup is upwardly open at 66 and sized to receive a float ball 70. The ball cup 60 depends below the plane of the baffle plate 54 proper and is provided with a number of perforations or small diameter holes 72 within the flat bottom wall 64 so that the rising water can enter the interior of cup 60 and lift the buoyant float ball from the full line position shown in FIG. 2, in the direction of arrow 94, towards the dome or cover 18.

The ball cup 60 as seen in FIG. 3 is radially outside the aqua filter tube assembly water entraining tube 28, as is the riser tube 50, with the cup 60 positioned circumferentially to one side of the riser tube 50.

Projecting upwardly and integrally molded with the water baffle plate 54, is a standing post 76 which is of relatively small diameter and which tapers in the direction towards its tip 76A. Unlike the riser tube of U.S. Pat. No. 5,343,592, the upper end of the riser tube 50 is terminated by a friction fit, riser tube cap indicated generally at 78, of tubular cylindrical form. Cap 78 has a radially enlarged portion 78A at a lower end thereof forming a recess 79, sealably receiving the upper end of the riser tube 50. The top 78B of the riser tube cap is of spherical configuration. A spherical opening defining a riser tube inlet port 80 is formed within the side of the riser cap beneath the spherical top 78B, faces toward the ball cup 60 and is sized to that of the ball float 70. The dirt free air airstream, indicated by the large heavy arrow 84, FIG. 1, enters the spherical opening or rises tube inlet port 80 within the side of the riser tube cap 78 and passes downwardly therein as indicated by arrow 86, exiting through the riser tube outlet port 53. The ball cup 60 is purposely positioned below the vacuum stream 84, FIG. 3, and shielded therefrom.

Further, the density of the float ball is selected so that, under normal conditions, the float ball 70 seats within the vacuum cup of the ball cup 60 by gravity. The float ball is preferably injection molded from polypropylene, is seamless and has a diameter of 38 mm in the illustrated embodiment of FIGS. 1–3 and is of 0.24 g/ml density. As such, the float ball is approximately 0.2 oz in weight.

The density of the float ball 70 is critical to the automatic, controlled operation of the float ball in sealing off the riser tube inlet port 80 at the top of the riser tube 50 and within the riser tube cap 78. The riser tube cap 78 is preferably provided with a 38 mm spherical radius inlet port 80 which matches the diameter of float ball 70 to provide an effective watertight seal to prevent air entrained water from entering the interior of the riser tube, when subjected to normal vacuum pressure and to prevent vacuum drawing of water into the pump 87 or its electrical drive motor (not shown).

In operation, as water, dirt and air are taken into the recovery tank 1, the water by gravity accumulates at the bottom of the recovery tank 12, the entrained dirt stays with the water and the dirt-free air 84 is sucked into the riser tube cap inlet port 80, passing downwardly through riser tube 50 and outlet port 55 as per arrow 85, and then laterally to the source of vacuum indicated schematically by arrow 87, conventionally a vacuum pump (not shown) within the extraction machine casing.

With the rise of the water level L, the float ball, being relatively light, rises up and out of the perforated ball cup 60, lifted up by water W entering perforations 72. After an approximately two inch of rise, the float ball 70 moves from a position, shielded from air stream 84 by the imperforate conical wall 62 of cup 60 and or baffle plate 54, and reaches the level of vacuum induced,air stream 84, FIG. 1, and is rapidly sucked into the spherical inlet port 80 of the riser tube cap 78. The matching radius of these two components creates an air tight seal therebetween, thus preventing any moisture from entering the vacuum source due to overfilling of water within recovery tank or dump bucket 12.

Upon termination of vacuum pressure, the ball float 70 drops by gravity back into the ball cup 60, guided by the standing post 76.

By shutting off the machine, the dome which is sealed tight against the lip 12B of the recovery tank sidewall 12A through an annular gasket 90, by suction pressure can be readily lifted without disturbing the components interior of the recovery tank such as the elements of the aqua filter tube assembly 26, riser tube 50 or the ball float riser tube inlet port shut-off device 10.

Figure 4:
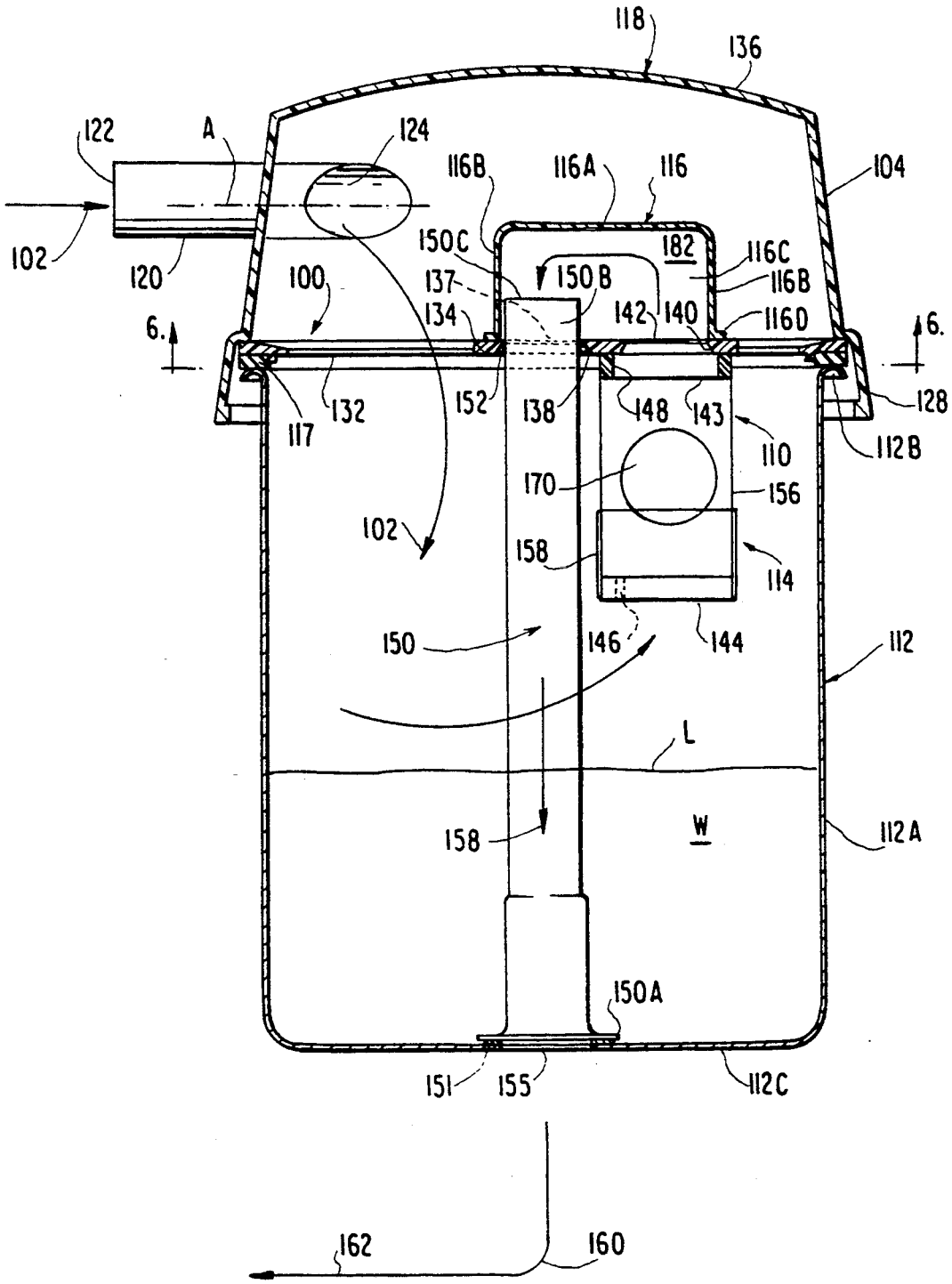
FIG. 4 is a schematic vertical view of a ball float sealed, riser tube inlet port shut-off device for a hot water vacuum extraction machine forming a second embodiment of the invention.
Figure 5:
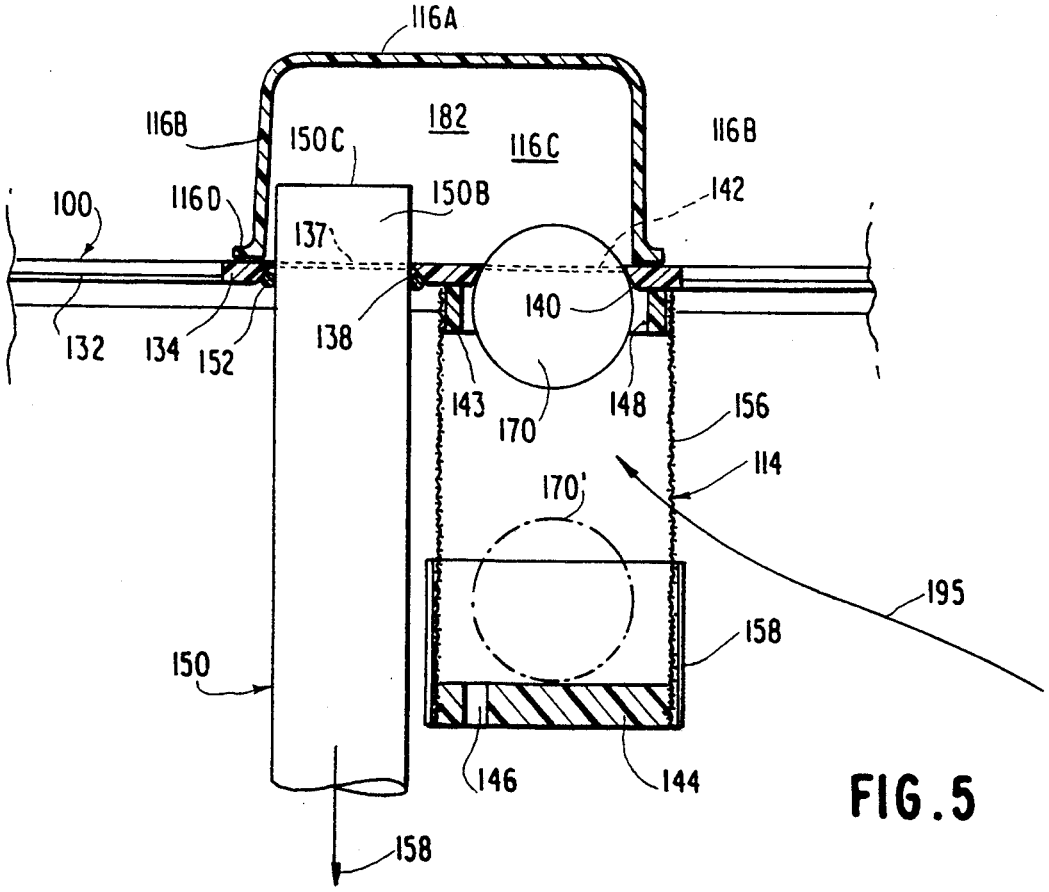
FIG. 5 is a schematic, enlarged vertical sectional view of the principal components of the ball float sealed riser tube inlet port shut-off device of FIG. 4.
Figure 6:
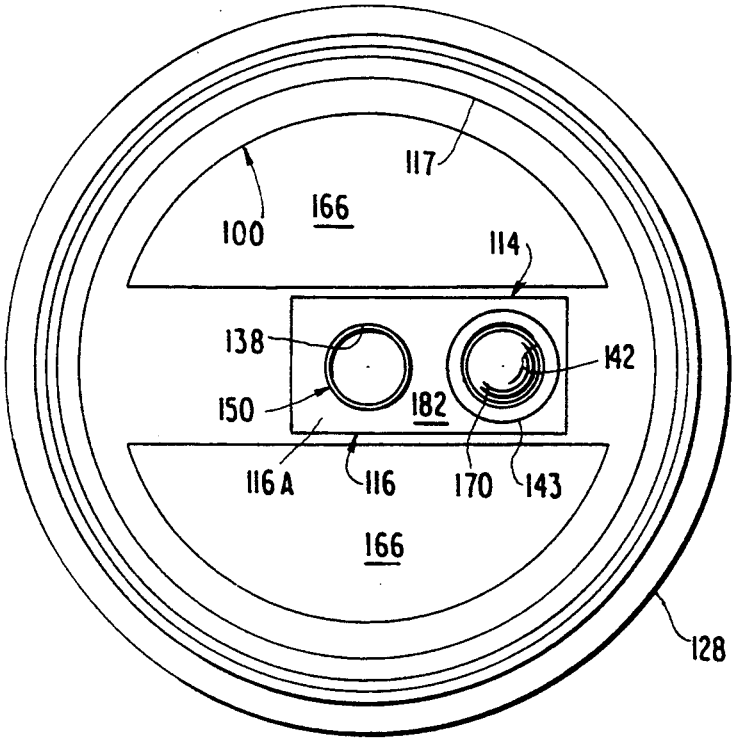
FIG. 6 is a horizontal sectional view of the recovery tank and the ball float shut-off device for the riser tube inlet port taken about lines 6—6 of FIG. 4.

Referring to FIGS. 4, 5 and 6, an automatic riser tube inlet port shutoff device indicated generally at 110, forms a second embodiment of the invention. It is incorporated within a recovery tank or dump bucket indicated generally at 112 for use in a hot water vacuum extraction machine which lacks the aqua filter assembly 26 of the first embodiment.

The second embodiment of this invention constitutes a modification of a steam cleaner dump bucket or recovery tank such as that set forth in U.S. Pat. No. 4,122,579 issued Oct. 31, 1978 and entitled "Steam Cleaner Dump Bucket", whose content is incorporated herein by reference. In this embodiment, the return air, stream with retained water and dirt, indicated generally by arrow 102, does not enter the interior of the recovery tank 112 through an inlet port within the dome 118 coinciding with the common axis of the recovery tank 112 and the dome or cover 118. The return flow inlet tube 120 is oriented relative the axis A of the inlet tube tangential to the annular sidewall 104 of a dome 118. The effect of this is to cause the water and entrained dirt to exit end 124 of tube 120 and impact the inner peripheral surface of the dome sidewall 104 and to move downwardly and over an annular shelf or dome insert indicated generally at 100 and through openings 166 radially interiorly of the annular shelf 100 for gravity accumulation within the bottom of the recovery tank 112. The recovery tank 112 may be formed of steel and upon accumulation of water and entrained dirt when the unit is used in a wet vacuum cleaning mode, may be periodically dumped after pulling of the same from the steam cleaner or hot water vacuum extraction machine casing (not shown), within which the tank 112 is disposed in vertically upright fashion. The recovery tank has a cylindrical side wall 112A sealed off by an integral bottom wall 112C, and is open at the top. The second embodiment is devoid of an aqua filter tube assembly such as tube assembly 26 of the first embodiment. However, there is an aqua filter action by the simple act of the entrained dirt and water within the return flow 102 falling by gravity into a mass of water W accumulating in or having been placed in the recovery tank 112 to a level L and being separated thereby from the return air stream.

The dome or cover 118 is preferably of transparent or translucent plastic so that the accumulating water and the entrained dirt may be seen visually through the top 136 of that dome. The dome terminates in a radially enlarged flange 128. Interposed between the dome 118 and the radially outwardly flared lip 112B, at the upper end of the recovery tank 112, is the dome insert or shelf assembly 100 which may be a molded plastic member of generally annular form. The dome insert 100 has a diametrically extending, integral strut 134 passing through the center of that annular member. An open cell, dome gasket 117 of circular strip form and of neoprene or the like is fixed to the bottom surface of the annular shelf 110, and rests on the lip 112B of the recovery tank. Upon the application of suction pressure, the dome 118 is sealed to the recovery tank 112 via gasket 116.

The return airstream 102 which may be a mixture of air, a liquid such as water and detergent, along with entrained dirt and debris captured during the cleaning process, enters the open end 122 of return flow tube 120 which mounts tangentially to the dome sidewall 104. Such flow internally of the dome 126 impinges on the interior surface of the oblique annular sidewall 104 of the dome after the detergent-containing water and entrained dirt are picked up by a vacuum head (not shown) coupled by a hose or ward to dome inlet tube 120. The dirty water thus forced through the inlet tube 120 and sprayed against the inner surface of the dome sidewall 104 runs down the sidewalk of the dome 118, over the annular shelf 100, and to falls off the annular edge 132 the shelf 100 at opening 166 and deposits by gravity into the water W which is at a given level L as shown in FIG. 4. All of this is in accordance with U.S. Pat. No 4,122,579.

Further, as evidenced in that patent, the recovery tank 12 is provided with a vertically upright, axially centered riser tube, indicated generally at 150, having a flanged end 150A which is brazed or otherwise sealed at 151 to the bottom wall 112C of the recovery tank 112. The bottom wall of the recovery tank is provided with an axially centered outlet port 155 which is connected to a source by passage 60 to a vacuum source indicated schematically by headed arrow 162. In this manner, the interior of the recovery tank 12 above the water level L is subjected to vacuum pressure. Conventionally, as in U.S. Pat. No. 4,122,579, the upper end 150B of the riser tube projects through an opening or hole 136 within the center of the strut 134 such that open end 150C of the riser tube 150 opens outwardly towards the volume beneath the dome 118. The dome insert or annular shelf 100, is molded so as to form a pair of half moon shaped openings 166, FIG. 3, to opposite sides of the strut 134. These openings permit the dirty water to flow downwardly by gravity into the bottom of the steel recovery tank 112 during hot water vacuum extraction.

Dump tanks or recovery tanks such as that in U.S. Pat. No. 4,122,579 in the past, have been provided with filter structures mounted to the end of the riser tube which projects above the strut.

The second embodiment of the present invention advantageously uses a cylindrical filter screen structure indicated generally at 114 as part of the automatic riser tube inlet port shut-off device indicated generally 110 forming a second embodiment of the invention. It should be appreciated from FIG. 4, that the portion of the return air stream 102 constituted by the air stream under vacuum pressure which is sucked up by the hot water extraction machine or steam cleaner head (not shown) of a vacuum wand or the like seeks the open end 150C of riser tube 150 which by vacuum pressure internally of the recovery tank 112 sealed off by its overlying dome or cover 118.

In that respect, in the schematic representation in FIG. 4, the headed arrow 168 identifies the dirt free and essentially liquid free air stream seeking to enter the upper end 150B of the riser tube. In this embodiment of the invention, the strut 134 is provided with a first conical bore 138 which forms the small diameter circular hole 137 sized to the outside diameter of the inserted riser tube 150. Interposed between the conical bore 138 and the outer periphery of the riser tube is an 0-ring 152 functioning as a seal to prevent in part, liquid from passing upwardly along the outside of the riser tube and from entering the open end 150C of that member by suction.

A second conical bore 140 is formed within the strut 134 longitudinally displaced from conical bore 138, FIG. 5. The conical bore 140 constitutes a valve seat for shut-off device 110. Further, that conical bore may be slightly curved axially, and thus of spherical form so as to conform to the spherical peripheral surface of a shut-off float ball 170. The circular upper edge 142 of the conical valve seat at 140 constitutes the inlet port for the riser tube 150 as will be appreciated hereinafter.

Since the valve seat 140 is displaced to one side of the open end 150C of the riser tube, there is necessarily required the presence of a sealed passage between conical bore 140 defining the inlet port 142 for riser tube 150, and the open end 150C of that riser tube. An inverted, elongated generally parallelpiped molded plastic air passage cover 116 has integrally, a flat top wall 116A, longitudinally opposed end walls 116B, laterally opposed sidewalls 116C and a unitary, outwardly projecting flange 116D integral with the end walls and sidewalls. With the air passage cover inverted, FIG. 5, the flange 116D is adhesively bonded to the top of the strut 134. The air passage cover 116 is sized so as to envelop the area defined by the conical bores 138, 140 within the strut 134. The strut 134 and the air passage cover 116 therefore defines a sealed air passage 182 from the valve seat inlet port 142 of the riser tube 150, to the open end 150*c* of the riser tube.

A float ball 170 is captured within the cylindrical filter screen assembly 114. That assembly 114 is constituted by an upper circular disk 143 and a lower disk 144 of a diameter in excess of that float ball 170. The disks 143, 144 may be formed of suitable plastic of a given thickness so as to provide structural rigidity to the screen assembly 114. A cylindrical filter screen 156 is interposed between and in cylindrical surface contact with the outside peripheries of respective disks 143, 144 at respective, opposite ends of the screen 156. The ends of the filter screen 156 may be adhesively coupled to respective disks 143, 144. The filter screen 156 may be a forty mesh screen formed by 0.010 diameter wire. The upper disk 143 is provided with a central, circular hole 148 sized slightly larger in diameter, than the diameter of the float ball 170 and the conical bore 140 to permit the float ball 170 to pass freely therethrough, and to sealably lodge against the valve seat 140.

An important aspect of the present invention is the incorporation of an air shield tube 158 to the screen 156. In the illustrated embodiment the shield is a piece of two inch heat shrink tubing, of a plastic material which may be heat shrunk about the outer periphery of the wire mesh screen 156, at its lower end. The heat shrink air shield tube 158 which may be formed of a polyolefin has a vertical height somewhat on the order of the diameter of the float ball 170 such that, the dirt-free air stream 168 seeking entry into the riser tube 150 by way of the valve seat 140 and its riser tube inlet port 142 is prevented from impinging upon the float ball 170 when it is in the dotted line, at rest position 170′, FIG. 5, on the lower disk 144. Importantly, the lower disk 144 is provided with at least one water inlet and the filter screen drain hole, as at 146, which in the instant embodiment is about ⅛ inch diameter, to permit the water W rising upwardly within the recovery tank 112 to enter the interior of tube 158 and to float the float ball 170 off disk 144 in the direction of the valve seat 140, while confined within the cylindrical wire mesh screen 156. As the float ball 170 rises with the water W, it is exposed to and moves into the path of dirt-free air stream 195, FIG. 5 seeking riser tube inlet port 142.

The lightweight float ball 170, formed for example of a foam material under the trade name POLYPRO, will be rapidly driven with the airstream 195 through the circular hole 148 of the upper disk 143, and against the valve seat 140 to shut off riser tube inlet port 142. Closure of air passage 182 prevents the return air stream 158 within riser tube 150 carrying liquid particles from reaching vacuum source 162 provided by a vacuum pump and its drive motor (not shown) within the hot water vacuum extraction system or steam cleaner to which the invention has application.

Upon the termination of the suction pressure within the riser tube 150 and the air passage 182, the float ball 170 falls by gravity from the full line position shown in FIG. 5 to the dotted line position 170' of that figure. Float ball 170 is then ready to again, automatically shut-off the return suction passage 182, but only upon the conditions where, the rising water W first enters the interior of the air baffle tube 158 and raises the float ball by a distance approximately equal to its diameter thereby placing float ball 170 in the path of the dirt-free airstream 195 FIG. 5 seeking passage through air passage cover 116 into the open end of the riser tube. The valve seat circular edge 142 functions as the inlet port to that riser tube.

In the illustrated embodiment of FIG. 5, the rise of the float ball 170 a distance of 2 inches above the lower disk 144, the shrink tube 158 no longer acts as an air flow shield for the filter screen assembly 114. When the float ball 170 is impacted by the vacuum induced air stream 195 it is rapidly sucked against the valve seat 140 of the dome insert or annular shelf 110. The matching surfaces on the conical valve seat 140 and float ball 170 create an airtight seal to prevent any air/water mixture from entering the vacuum source chamber. The upper disk 143 of the filter screen assembly 114 may be fixedly mounted to the bottom of the strut 134 by rivets (not shown).

The float ball 170 may be injection molded from polypropylene and may be of 38 mm diameter and 0.24 g/ml density and has for the illustrated second embodiment, approximately 0.2 ounces in weight. If the density is increased, the additional weight of the float ball 170 will not allow the ball to float into the vacuum stream, while too little weight will cause a premature shut-off closure of the float ball 170 on the valve seat 140. The air passage cover 116 may be vacuum formed of LEXAN®. The o-ring 152, about the riser tube 150 may be formed of rubber, thereby creating an effective seal from the tank to the air passage cover to prevent loss of vacuum by leakage along the outer periphery of the riser tube where the upper end of 150B passes through the aperture of the strut 134. Further, the dome insert 110, and the dome may be made of vacuum formed LEXAN®. Appropriately, the corresponding members within the first embodiment may be formed of materials as described herein with respect to the second embodiment.

While the present invention has been illustrated by a detailed description of preferred embodiments thereof, it will be obvious to those skilled in the art that various changes in form and detail can be made therein without departing from the true scope of the invention. For that reason, the invention must be measured by the claims attended hereto and not by the foregoing preferred embodiments.

What is claimed:

1. In combination, a recovery tank for a hot water vacuum extraction machine subject to vacuum pressure from a vacuum source, and an automatic riser tube inlet port shut-off device, said recovery tank comprising an upwardly open cylindrical container carrying liquid in the bottom thereof for separating dirt and/or water from a return flow of at least air and entrained dirt during vacuum extraction into said recovery tank when subject to vacuum pressure from said vacuum source, said cylindrical container having an integral bottom wall, an inverted cup-shaped dome for receiving said return flow sealably mounted on the upwardly open recovery tank, an upright riser tube mounted to said recovery tank bottom wall, rising upwardly therefrom, being open to the recovery tank above said liquid and being open internally to vacuum pressure from said vacuum source, means defining a riser tube inlet port in the vicinity of said dome and above said recovery tank bottom wall, means sealably fluidly communicating the interior of said riser tube to the interior of said recovery tank for sucking a return flow stream of dirt-free air into said riser tube via said riser tube inlet port by vacuum pressure from said vacuum source, and wherein said shut-off device comprises:

a shut-off float member;

fixed supporting means within said tank for supporting said float member in a rest position below said riser tube inlet port;

shielding means above said supporting means for maintaining said float member free of restraint and out of the dirt-free return air stream seeking escape from the interior of the tank above the level of liquid within the recovery tank;

means for contacting said shut-off float member in said rest position with said liquid upon rise of the liquid to the level of the float member at its rest position, to float said float member in the direction of said riser tube inlet port;

said float member and said riser tube inlet port being sized and shaped such that said float member is capable of sealably closing off said riser tube inlet port when in contact therewith, and wherein said float member is of a predetermined density such that;

the rise of liquid initially causes the float member to float upwardly from said rest position on said supporting means to an intermediate position relative to that of said riser tube inlet port at least partially above said shielding means, thereby placing said float member within the dirt-free return flow air stream; and the suction pressure of said riser tube then quickly sucks the float member off the rising liquid and into contact with the riser tube inlet port to shut off communication between the vacuum source and the interior of the recovery tank, thereby preventing an air/liquid mixture from passing to the vacuum source through said riser tube due to an excessive increase in the level of liquid accumulating within said recovery tank.

2. The combination as claimed in claim 1 wherein a baffle plate is mounted horizontally within said recovery tank, an upper end of said riser tube passes through said baffle plate, said riser tube inlet port is within said riser tube at a level above said baffle plate, and said device further comprises an upwardly open cup carried by said baffle plate to one side of said riser tube and depending downwardly from the baffle plate;

said float member when at rest being carried internally of said cup;

at least one of said baffle plate and said cup comprising said shielding means for shielding said float member from said dirt-free return stream at said float member rest position and;

wherein, said cup carries at least one perforation in bottom surface thereof permitting entry of said liquid to the interior of said cup to cause said float member to be displaced upwardly therefrom and into said dirt-free return air stream seeking said riser tube inlet port.

3. The combination as claimed in claim 2, wherein said inlet port is within the side of the riser tube facing said cup carried by said baffle plate and wherein, a spike is fixed to and rises upwardly from the top of said baffle plate to a side of said cup to guide said float member during rise from said rest position to at least said intermediate position.

4. The combination as claimed in claim 2 wherein said perforated cup is integrally molded to said baffle plate.

5. The combination as claimed in claim 2 wherein said baffle plate, said cup and said spike constitute an integrally molded member.

6. The combination as recited in claim 1 wherein said float member is a float ball.

7. The combination as claimed in claim 6 wherein said inlet port of said riser tube has a configuration conforming to the periphery of said ball float.

8. The combination as claimed in claim 7, wherein the upper end of said riser tube terminates in a riser tube cap having a top wall of semi-spherical form, and said spherical riser tube inlet port is within said riser tube cap, beneath said semi-spherical top and above said baffle plate.

9. The combination as claimed in claim 6, wherein said float ball is a seamless injection molded polypropylene ball of approximately 0.24 g/ml density so as not to prematurely float into the dirt-free return air stream but being of sufficient mass to prevent premature shut-off of the riser tube-inlet port.

10. The combination as claimed in claim 1, wherein a flat plate is fixedly mounted within one of said recovery tank and said dome and extends horizontally across the interior thereof, at a level above the liquid within the bottom of said recovery tank, said flat plate includes a pair of longitudinally spaced holes within said flat plate, an imperforate return air passage cover is sealably mounted about edges thereof to the top of the flat plate and defines with said flat plate a sealed return air passage between said first and second holes within said flat plate, said riser tube projects vertically upwardly within one of said holes, is sealably mounted therein, and opens to the interior of the return air passage, the other of said holes opens downwardly to the interior of said recovery tank, wherein said fixed means supporting said float member at a rest position is positioned below said other hole, and is in alignment with said other hole, and wherein said fixed means includes means confining the float member, during movement of said float member from said initial rest position, through said intermediate position to a position in contact with and sealing off said other hole within said flat plate such that said other hole constitutes a valve seat for said float member and defines said riser tube inlet port.

11. The combination as claimed in claim 10, wherein said fixed means within said tank for supporting said float member in said rest position comprises a filter screen assembly fixed to a bottom surface of said flat plate and depending downwardly therefrom, and wherein said filter screen assembly includes an open mesh screen surrounding said float member and has a bottom surface upon which said float member rests absent contact with said liquid and or vacuum pressure application by said riser tube to the interior of said recovery tank.

12. The combination as claimed in claim 11, wherein said filter screen assembly is of elongated cylindrical form, and comprises a cylindrical sidewall of open mesh screen material and an imperforate tube of a vertical height approximately equal to the vertical height of said float member is carried by said filter screen assembly about a bottom portion of said mesh screen cylinder and constitute a shield for shielding off the float member from said dirt-free return flow stream seeking said riser tube inlet port.

13. The combination as claimed in claim 12 wherein said filter screen assembly comprises a pair of disks fixedly mounted respectively at opposite ends of the cylindrical mesh screen, sized thereto and being positioned internally thereof, one of said disks being fixedly mounted to the bottom surface of said flat plate and having an internal bore sized in excess of the riser tube inlet port and said float member so as to permit said float member to pass therethrough and to shut off said riser tube inlet port, and the other of said disks including at least one liquid inlet port passing therethrough and constituting said means for contacting said shut-off float member with said liquid for floating the float member to said intermediate position above the shield tube and into the path of the dirt-free return air flow for rapidly propelling the float member off the liquid and against to said riser tube inlet port.

14. The combination as claimed in claim 10 wherein said float member is a ball.

15. The combination as claimed in claim 10, wherein an annular dome insert is positioned within said dome and carries a gasket on a bottom surface thereof, extending about the periphery thereof and effecting a sealable mount of the upper end of the recovery tank on said cylindrical container, and wherein said dome insert includes a diametric strut intersecting the riser tube and constituting said flat plate.

* * * * *